United States Patent [19]

Palm

[11] 4,171,678

[45] Oct. 23, 1979

[54] AIR HORN

[75] Inventor: Walter C. Palm, Grand Rapids, Mich.

[73] Assignee: Midland-Ross Corporation, Cleveland, Ohio

[21] Appl. No.: 818,163

[22] Filed: Jul. 22, 1977

[51] Int. Cl.[2] ..... G10K 9/04

[52] U.S. Cl. ..... 116/142 FP; 181/159

[58] Field of Search ..... 116/142 R, 142 FP, 142 FV; 340/391, 388; 181/159, 166, 173

[56] References Cited

U.S. PATENT DOCUMENTS

| | | | |
|---|---|---|---|
| 2,248,073 | 7/1941 | Gage | 116/142 FP |
| 2,281,611 | 5/1942 | Williams | 116/142 FP |
| 2,352,467 | 6/1944 | Broden | 116/142 FP |
| 2,642,028 | 6/1953 | Johnson | 116/142 R |
| 2,918,895 | 12/1959 | Buell | 116/142 R |
| 2,944,509 | 7/1960 | Shintaku | 116/142 R |
| 3,429,294 | 2/1969 | Holm | 116/142 R |
| 4,050,405 | 9/1977 | Palm | 116/142 FP |

*Primary Examiner*—Daniel M. Yasich

*Attorney, Agent, or Firm*—H. Duane Switzer

[57] ABSTRACT

A springless diaphragm-type air horn provided with fixed structure for controlling the amplitude of diaphragm oscillation to thereby enable manufacturing of the horn without necessity for any adjustment of parts to achieve tone control.

13 Claims, 14 Drawing Figures

AIR HORN

BACKGROUND OF THE INVENTION

Although springless air horns are known in the prior art, the types of air horns prevailing in the present market require that the horn diaphragm be subjected to spring loading in a direction forcing the diaphragm against the mouth of the duct for projecting resonated air into its trumpet. A common disadvantage of either the springless or the spring-loaded horns is that they must be adjustably tuned or parts, such as springs, made to very precise standards to obtain satisfactory operation. Moreover, these prior art horns, in general, are operable at undesirably narrow pressure ranges. This is a serious disadvantage if the tank pressures vary to any great degree, such as often happens in the case of unusual brake usage or leaks in the air system. Because of the mode by which a spring resists oscillation of the horn diaphragm, precision of spring loading to effect tuning is required on spring equipped horns with the result that such horns perform in a somewhat smaller pressure range than is satisfactory. In the prior art springless horns, the diaphragm itself provides the spring force and must be constructed to a thickness which provides the diaphragm resiliency required for an intended air pressure.

Hence, objects of the invention are (1) to devise an air horn with a minimum of parts which can be assembled to operative condition without the need for tuning adjustments, and (2) that a horn so devised will produce satisfactory horn sounds by application of air under a very wide range of supply pressures.

SUMMARY OF THE INVENTION

In bringing about the present invention, it has been discovered that resilient cushioning of the diaphragm by a spring or otherwise for controlling oscillation amplitude and frequency suitable for satisfactory horn response at an available pressure range is not necessary, and that good horn performance may be obtained by control of a diaphragm clamped in a position of resilient deformation through the use of a fixed abutment surface located for limiting the oscillation of the diaphragm away from the interior mouthpiece of the horn. The diaphragm, by engaging the abutment surface, vibrates in accordance with entirely different physical behavior than when the vibrations are limited by spring cushioning.

The present invention is achieved in a springless air horn consisting of a body and a cap fitting together to define an interior region with portions thereof in both the cap and the body; a trumpet affixed to the body contiguously with a duct extending through the body which is partially formed by a hollow boss or annular mouthpiece projecting through the body portion of the region; and a diaphragm which is generally planate at a condition of rest, but in the assembled horn, is deformed to a concavo-convex tensioned condition over the mouthpiece by being clamped continuously along its periphery between the cap and the body.

The invention resides especially in an internal contour of the cap which provides an abutment surface in closely-spaced, coaxial, axially-opposed relation with that portion of the diaphragm in resilient engagement with the end surface of the mouthpiece. Preferably, the abutment surface is provided as the end surface of an integral boss extending axially toward the mouthpiece from the main wall of the cap with its end surface spaced, e.g., 50 to 60 thousandths of an inch, from that portion of the diaphragm covering the end surface of the mouthpiece.

With the introduction of the abutment surface into the horn structure, the amplitude of the diaphragm oscillation is controlled at any pressure within an unusually large range of pressures applied to the pressure chamber to induce passage of air between the diaphragm and the end surface of the mouthpiece. A very thin diaphragm, e.g., for comprising stainless steel with a thickness of 0.003 of an inch, may be used. Such thin diaphragms are yield to very low air pressures, such as 5 pounds per square inch (psi) to produce good horn operation, and because of the oscillation amplitude control, respond with true horn sounds to pressures as high as 225 psi or more. Thus, a horn equipped with a thin diaphragm and amplitude control structure as taught herein is operative under a broad range of pressures that may be encountered under vehicle operating conditions.

DESCRIPTION OF PREFERRED EMBODIMENT

Figure 4:
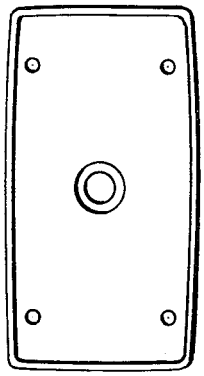
FIG. 4 is a front end view of the trumpet of the horn of the preceding figures with the bug shield of FIGS. 6 and 7 removed.
Figure 3:
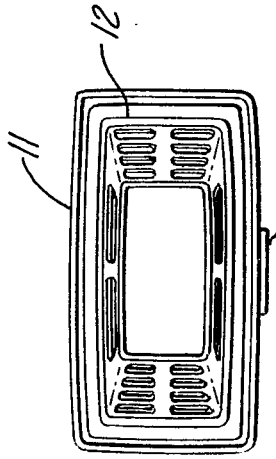
FIG. 3 is a front end view of the horn illustrated in FIGS. 1 and 2.
Figure 2:
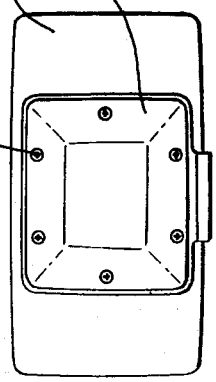
FIG. 2 is a rear end view of the horn illustrated in FIG. 1.
Figure 1:
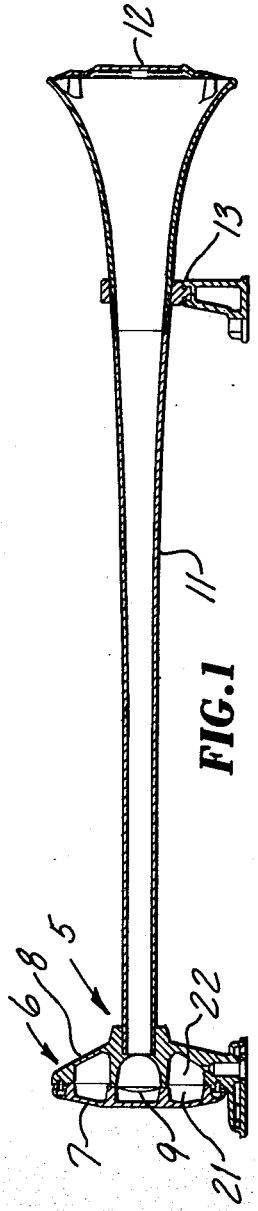
FIG. 1 is a view in cross section taken along the longitudinal axis of a horn in accordance with this invention.
Figure 5:
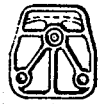
FIG. 5 is a bottom view of the base of the body of the horn appearing in FIG. 1.
Figure 6:
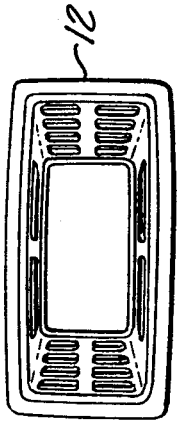
FIGS. 6 and 7 are front and top views of the bug shield shown attached to the horn in FIGS. 1 and 3.
Figure 7:
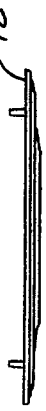
Figure 8:
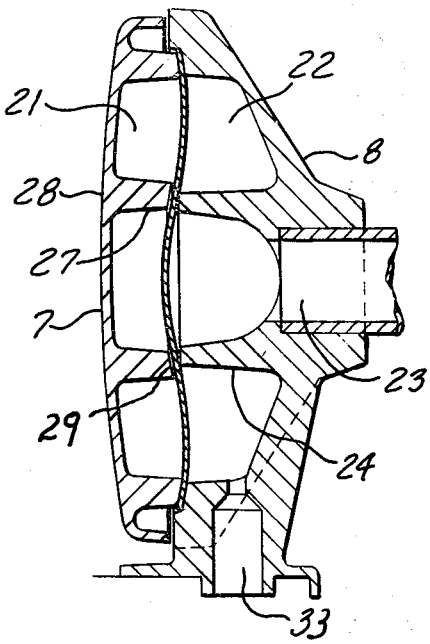
FIG. 8 is an enlarged view in vertical cross section of the cap, body, and diaphragm taken along the longitudinal axis of the horn of FIG. 1.
Figure 9:
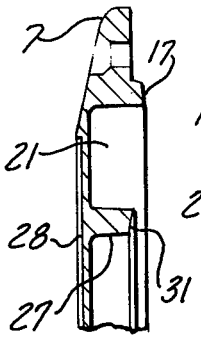
FIGS. 9 and 10 are fragmentary views in cross section of the cap and body of FIG. 8.
Figure 10:
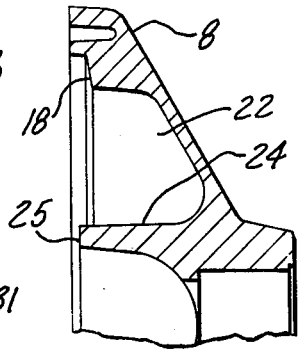
Figure 11:
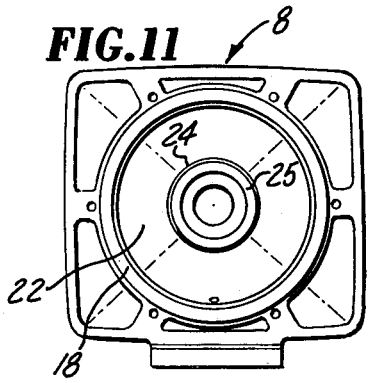
FIG. 11 is an interior face view of the horn body of FIGS. 1 and 8.
Figure 12:
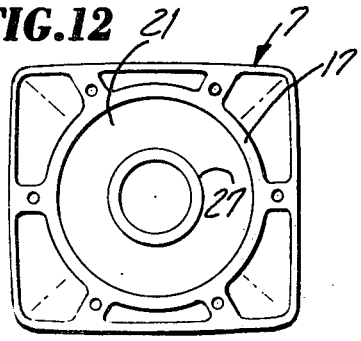
FIG. 12 is an interior face view of the horn cap of FIGS. 1 and 8.

FIG. 1 illustrates a horn 5 according to this invention which comprises a housing consisting of a cap 7 and a body 8, a diaphragm 9 received between the cap and the body, a trumpet 11, a bug screen 12, and a trumpet support 13. FIGS. 2, 3 and 4 indicate that the trumpet and housing of the horn, as viewed from the front and the rear, are of rectangular shape for stylization.

The cap and the body are secured together by fasteners, such as screws 15, driven tightly into body to clamp the diaphragm 9 between frusto-conical surfaces 17, 18 of the cap and the body, respectively. When secured together, the cap and body enclose a circular region divided by the diaphragm 9 into a back chamber 21 enclosed essentially by the cap and a pressure chamber 22 enclosed essentially by the body. As shown, the body 8 has central duct 23 counter-bored at one end to receive the rear end of the trumpet 11 and formed at its other end interiorly of the chamber 22 by an annular boss or mouthpiece 24 terminating in an annular boss end surface 25. As shown, the cap 7 has an annular abutment ring 27 extending axially inwardly from its outer end wall 28 to an abutment ring end surface 31 positioned in close spaced proximity with that portion of the diaphragm supported by the end surface 25 of the mouthpiece. The end surface 31 functions as abutment means for limiting the amplitude of diaphragm oscillation.

As FIGS 8 to 12 show, the diaphragm-clamping surfaces 17, 18 are annular, coaxial, circularly-continuous, frusto-conical, and extend in a radial direction with respect to a plane perpendicular to their axes containing end surface 25 of the mouthpiece. As shown, the surface 25 has a plane spaced slightly rearwardly of any transaxial plane of both surfaces 17, 18 in the assembled horn. Assembling of the horn to the condition of FIG. 8 has the effect of placing the diaphragm in a state of resilient deformation in which it forms a domed or concavo-convex portion extending over the mouthpiece 24 to cause the diaphragm to bear on the surface 25 at a desired pressure. In other words, clamping surfaces 17, 18 slope from their outer edges to their inner edges in a direction along the boss 24 from the boss end surface 25. In the assembled non-operating condition of the horn, the clamping surfaces 17, 18 thereby hold the diaphragm 9 in a deformed condition extending inwardly from between the clamping surfaces 17,18 in a direction spaced along the boss 24 from the boss end surface 25, and then being reversely resiliently curved to extend in a generally opposite direction along the boss 24 in an outward curve across the boss end surface 25. This reverse curvature of the diaphragm provides spring action in the diaphragm itself. Vibration of the diaphragm in the assembled horn is induced by supplying air through an opening into the pressure chamber 22 at sufficient pressure to intermittently lift the diaphragm away from the surface 25.

When the pressure is excessive in respect to the strength or thickness of the diaphragm, the diaphragm will be continuously deflected without satisfactory vibration away from the surface 25 and the horn will fail to emit a resonated signal. It is in this situation that the annular boss or control ring 27 is useful. The ring 27 is shaped to provide a clearance 29 between the diaphragm at rest on the surface 25 and the end surface 31 of the ring which will cause the diaphragm to resiliently impact the end surface 31 during which there is a slight pressure drop in the chamber 22 and the diaphragm completes a cycle by relaxing reversibly against the end surface 25. An amplitude range for oscillation of the diaphragm between surfaces 25 and 31 in the range of 40 to 60 thousandths of an inch, especially at around 50 thousandths of an inch, is found to result in satisfactory horn tones for stainless steel diaphragms having a thickness of approximately 0.003 of an inch. Oscillation of the diaphragm productive of good horn sound is induced by pressures to chamber 22 of 5 to 225 pounds per square inch.

When the cap abutment 27 is a ring such as shown, the surface 31 is frusto-conical with the radial cant of the surface being radially inwardly toward the cap end wall 28. The cant of this surface is selected to an angle which causes the surface 31 to be approximately tangential to the convexity of that portion of the diaphragm engaged thereby. This is to prevent the diaphragm from taking a permanent set or crease such as might occur from line contact with the control ring 27 at high pressure.

In a horn proportioned as shown, exemplary general dimensions, such as used in actual practice, are approximately an outside cap width of 4 inches, an outside control ring diameter of approximately 1½ inches, an inside control ring diameter of approximately 1⅛ inches, an outer mouthpiece diameter of 1¼ inches, an inside mouthpiece diameter of 1 inch, an outer diameter of the diaphragm and of surface 18 of about 3½ inches. When the horn is proportioned according to the above dimensions, a preferred radial cant of surfaces 17 and 18 with respect to a perpendicular transaxial plane is about 7 degrees; the angle of cant of the surface 31 is also about 7 degrees. Of further note is that the outer diameter of the mouthpiece at surface 25 is approximately equal to the median diameter of surface 31 thereby resulting in some radial overlap of the surface 31 with the surface 25 but considerable radially outward projection of the surface 31 beyond surface 25.

Figure 13:
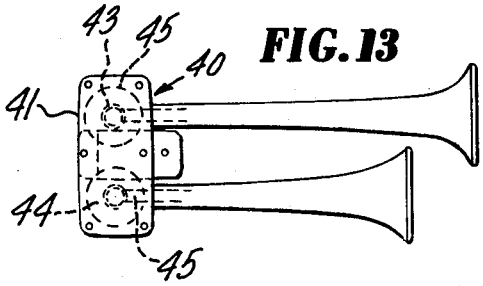
FIG. 13 is a plan view of a two-trumpet horn having a single housing enclosing two resonating regions contiguous with the trumpet.
Figure 14:
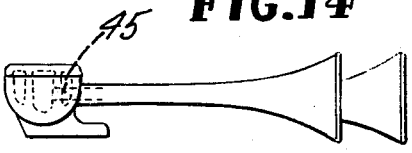
FIG. 14 is a side view of the horn of FIG. 13.

FIG. 13 illustrates a plural trumpet horn 40 having a single housing 41 but two trumpets resonated by, and connected with, internal regions 43,44 which discharge pulses of air past diaphragm portions to respective trumpets by internal ducts 45. In a horn such as illustrated in FIG. 13, the housing 41 must be deep enough in the axial direction of regions 43 and 44 to provide a right angle duct 45 for each region corresponding in function to duct 23 of FIG. 8 for placing the trumpets in duct relation with the mouthpieces of regions 43,44.

What is claimed is:

1. An air horn comprising: a body and cap secured together in clamping relationship to a peripheral portion of a diaphragm to define a pressure chamber on the body side of said diaphragm and a back chamber on the cap side of said diaphragm, said body having an integral hollow boss projecting centrally into said pressure chamber and terminating in an annular boss end surface, said diaphragm in the assembled non-operating condition of said horn being held in yieldable engagement with said annular boss end surface solely by clamping action of said body and cap on said peripheral portion of said diaphragm and resiliency of said diaphragm, an abutment integral with said cap and projecting centrally into said back chamber, said abutment having an abutment end surface positioned in nonengaging close spaced proximity to said diaphragm generally opposite from said boss end surface in the assembled nonoperating condition of said horn, said diaphragm being displaceable from said boss end surface in the operating condition of said horn and being returnable from such displacement solely by rebound action of said diaphragm striking said abutment end surface and by clamping action of said body and cap along with the resiliency of said diaphragm, said horn being operable by supply of air pressure to said pressure chamber for producing high frequency vibration of said diaphragm by lifting said diaphragm off said annular boss end surface which allows air to escape from said pressure chamber through said hollow boss and reduces the pressure in said pressure chamber and reduces the air pressure force acting on said diaphragm which then returns from displacement off said boss end surface solely by the resiliency of said diaphragm and the clamping action of said body and cap along with rebound action of said diaphragm striking said abutment end surface.

2. The horn of claim 1 wherein said diaphragm is curved outwardly across said boss end surface and said abutment end surface slopes generally tangent to the curvature of said diaphragm.

3. The horn of claim 1 wherein said abutment comprises a hollow ring and said ring has an outer end defining said abutment end surface, said boss end surface having inner and outer boss edges, said ring outer end having inner and outer ring edges, said ring inner edge being located opposite said boss end surface intermediate said inner and outer boss edges, and said ring outer edge being located outwardly of said boss outer edge.

4. The horn of claim 3 wherein said diaphragm is curved outwardly toward said ring outer end across said boss end surface, and said ring outer end being frusto-conical between said inner and outer ring edges at a slope such that said ring outer end extends generally tangent to the curvature of said diaphragm.

5. The horn of claim 1 wherein said diaphragm comprises a thin metal diaphragm which is normally flat prior to assembly into said horn, said peripheral portion of said diaphragm being clamped between mating clamping surfaces on said body and cap, said mating clamping surfaces being spaced in a direction along said boss from said boss end surface, said clamping surfaces being sloped from their outer edges to their inner edges in a direction along said boss from said boss end surface and holding said diaphragm in a deformed condition extending inwardly from between said clamping surfaces in a direction spaced along said boss from said boss end surface and then being reversely curved to extend in an opposite direction along said boss in an outward curve across said boss end surface, whereby the reverse curvature of said diaphragm provides spring action in said diaphragm.

6. The horn of claim 5 wherein said boss has a longitudinal axis extending substantially perpendicular to said diaphragm, and said clamping surfaces being sloped out of a plane perpendicular to said axis at angles of approximately seven degrees.

7. The horn of claim 5 wherein said abutment comprises a hollow ring and said abutment end surface is defined by the outer end of said ring, said ring outer end having outer and inner ring edges, and said ring outer end being sloped from said outer ring edge to said inner ring edge in a direction opposite to the direction of slope of said clamping surfaces at an angle approximately equal to the angle of slope of said clamping surfaces.

8. An air horn comprising: a body and cap secured together in clamping relationship to a peripheral portion of a thin metal diaphragm to define a pressure chamber on the body side of said diaphragm and a back chamber on the cap side of said diaphragm, a hollow boss integral with said body and projecting centrally into said pressure chamber, said boss having an annular boss end surface engaging a central portion of said diaphragm in the assembled non-operating condition of said horn, said diaphragm normally being flat prior to assembly into said horn and having a diaphragm peripheral portion clamped between mating clamping surfaces on said body and cap, said clamping surfaces being spaced along said boss from said boss end surface, said clamping surfaces sloping from their outer edges to their inner edges in a direction along said boss from said boss end surface and holding said diaphragm in a deformed condition extending inwardly from between said clamping surfaces in a direction spaced along said boss from said boss end surface and then being reversely resiliently curved to extend in an opposite direction along said boss in an outward curve across said boss end surface, whereby the reverse curvature of said diaphragm provides spring action in said diaphragm for aiding in imparting vibration to said diaphragm when air pressure is supplied to said pressure chamber, and said diaphragm being held in yieldable engagement with said boss end surface solely by said spring action and by clamping engagement of said diaphragm peripheral portion between said body and cap.

9. The horn of claim 8 wherein said clamping surfaces slope at an angle of approximately seven degrees.

10. The horn of claim 8 wherein said clamping surfaces and said boss end surfaces are located relative to one another such that said diaphragm extends inwardly between said body and cap from said clamping surfaces at a curvature which is approximately equal and opposite to the curvature of said diaphragm across said boss end surface.

11. The horn of claim 10 wherein said cap includes an integral hollow abutment ring extending centrally into said back chamber and having a ring end surface positioned in closely spaced proximity to said diaphragm generally opposite from said boss end surface.

12. The horn of claim 11 wherein said ring end surface is sloped to extend generally tangent to said diaphragm.

13. The horn of claim 12 wherein said boss end surface has boss inner and outer edges and said ring outer end has ring inner and outer edges, said ring inner edge being located intermediate said boss inner and outer edges, and said ring outer edge being located slightly outwardly of said boss outer edge.

* * * * *